United States Patent [19]

Conway

[11] Patent Number: 4,634,865

[45] Date of Patent: Jan. 6, 1987

[54] INTRODUCTION OF SAMPLES INTO A MASS SPECTROMETER

[75] Inventor: John K. Conway, Cambridge, England

[73] Assignee: Prutec Limited, London, England

[21] Appl. No.: 760,736

[22] PCT Filed: Nov. 20, 1984

[86] PCT No.: PCT/GB84/00399

§ 371 Date: Jul. 19, 1985

§ 102(e) Date: Jul. 19, 1985

[87] PCT Pub. No.: WO85/02491

PCT Pub. Date: Jun. 6, 1985

[30] Foreign Application Priority Data

Nov. 22, 1983 [GB] United Kingdom ..... 8331094

[51] Int. Cl.[4] ..... H01J 49/04

[52] U.S. Cl. ..... 250/288; 73/864.82; 73/864.85; 414/417; 250/289

[58] Field of Search ..... 250/288, 289; 73/864.82, 864.85; 422/65; 221/75; 414/225, 751, 416, 417

[56] References Cited

U.S. PATENT DOCUMENTS 4,076,982 2/1978 Ritter et al. ..... 250/288

4,405,860 9/1983 Brunnee et al. ..... 250/288

*Primary Examiner*—Carolyn E. Fields

*Assistant Examiner*—Jack I. Berman

*Attorney, Agent, or Firm*—L. Messulam

[57] ABSTRACT

Magazine for introducing samples into the inlet system of a mass spectrometer. The magazine (22) comprises a flat plate having upper and lower surfaces which are generally horizontal during use. A zig-zag groove (32) is formed in the lower surface engageable by a reciprocable pin (34) to advance the magazine (22) by increments relative to an aperture (12) of the inlet system (10) of the mass spectrometer and recesses (24) are formed in the upper surface of the magazine for receiving tubes (16) containing samples for analysis. The recesses (24) extend transversely to the direction of movement of the magazine (22) and are arranged at a regular pitch equal to that of the groove (32) in the lower surface.

6 Claims, 3 Drawing Figures

INTRODUCTION OF SAMPLES INTO A MASS SPECTROMETER

The present invention relates to the introduction of samples into the inlet system of a mass spectrometer.

The usefulness of mass spectrometry in analysis has long been recognised but the technique has hitherto suffered from the severe drawback that each analysis took a considerable time because the introduction of each sample called for the vacuum chamber to be opened. Before analysis could commence, the vacuum conditions needed to be re-established and in order to reduce the quantity of air entering the system with each sample, a series of locks was employed at the inlet system. The analysis therefore needed to be performed by skilled technicians with the result that mass spectrometers were regarded as specialised laboratory equipment rather than, for example, as apparatus to be used in quality control of mass produced products, where analyses need to be performed on a frequent and regular basis.

In GB-A-No. 2,141,230, there is described an inlet system for a pyrolysis mass spectrometer in which the above disadvantage is considerably mitigated allowing a complete analysis of a sample to be performed in only a very few minutes.

In the above Application, a sample container is offered to an aperture in the inlet system. The inlet system rapidly evacuates the container, pyrolyses the sample and establishes communication between the container and the vacuum chamber of the mass spectrometer to enable the sample to be analysed.

The present invention is concerned with the feeding of samples to such an inlet system in such a manner as to take advantage of the inherent speed of operation of the mass spectrometer and enable the process of analysis to be further automated.

According to the present invention, there is provided a magazine for introducing samples into the inlet system of a mass spectrometer, the magazine comprising a flat plate having upper and lower surfaces which are generally horizontal during use, a zig-zag groove in the lower surface engageable by a reciprocable pin to advance the magazine by increments relative to an aperture of the inlet system of the mass spectrometer and recesses in the upper surface of the magazine for receiving tubes containing samples for analysis, the recesses extending transversely to the direction of movement of the magazine and being arranged at a regular pitch equal to that of the groove in the lower surface.

Preferably, each recess in the upper surface comprises an enlarged diameter portion for receiving an O-ring placed over the outer surface of the sample tube.

Conveniently, each recess in the upper surface is formed at its end remote from the inlet system of the mass spectrometer with an enlarged diameter portion such that a pick-up tube may be slipped over the end of the sample tube while the latter is resting in the recess.

In the preferred embodiment of the invention, the zig-zag groove has first portions extending parallel to the recesses in the upper surface and parallel to the direction of movement of the indexing pin such that the movement of the pin, in use, in the first portions causes no movement of the magazine, and second portions each connecting one end of a first portion with the opposite end of an adjacent first portion, the second portions being inclined relative to the direction of movement of the magazine during use and cooperating with the pin to move the magazine.

The magazine may conveniently be packaged in combination with a plurality of tubes resting in the recesses, each fitted with an O-ring and a sample boat. The packaging may consist of a sealing wrapper serving to retain the sample tubes in position within the recesses. If the boats project from the sample tubes when the wrapper is opened the plsacing of the samples on the boats is considerably facilitated. In order to avoid accidental displacement the boats should not project beyond the edge of the magazine.

The invention will now be described further, by way of example, with reference to the accompanying drawings, in which.

Figure 1:
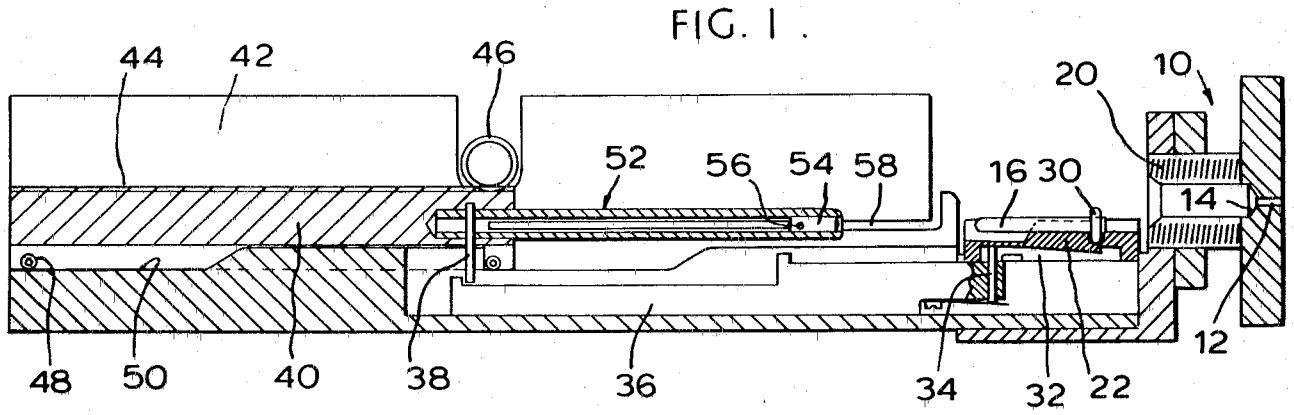
FIG. 1 is a section through a sample feed system for a mass spectrometer.

In FIG. 1, there is shown at 10 part of the inlet system of the mass spectrometer. The inlet system 10 is not shown in detail but is preferably as described in GB-A-No. 2,141,230. For the purposes of the present application, it suffices to know that the inlet system 10 has an aperture 12 with a conical mouth 14 against which a tube 16 containing a sample to be analysed is sealed, the sample resting on a metal boat within the tube 16.

After the tube 16 has been sealed against the aperture 12, the inlet system of the mass spectrometer evacuates the interior of the tube 16 and pyrolyses the sample by means of an induction coil 20 surrounding the tube 16. The coil 20 heats the boat in the tube 16 to a predetermined temperature (its Curie temperature) and thus pyrolyses the sample, the pyrolysate entering the vacuum chamber for analysis. After completion of the analysis, the tube 16 is withdrawn and replaced by a new tube.

Figure 2:
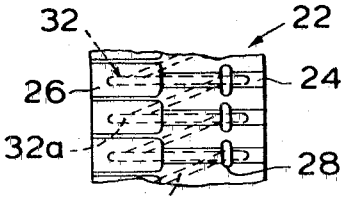
FIG. 2 is a partial plan view of the sample magazine used in the feed system of FIG. 1.

The tubes 16, which are to contain the analysis samples, are arranged in a magazine 22 which is advanced automatically by the feed system. As seen in the plan view of FIG. 2, the magazine 22 has parallel recesses 24 on its top face for receiving the tubes 16. Each recess is in the form of a semi-cylindrical trough which is enlarged at one end (left end as viewed). Because of this enlargement 26, the end of each sample tube 16 is surrounded by a gap while resting in the recess 24 thereby enabling a pick-up tube to be slipped over the end of the sample tube 16 so that it may be picked up from the magazine 22. Each recess also has a further enlarged diameter portion 28 which serves to accommodate an O-ring 30 surrounding each of the sample tubes 16.

It is envisaged that the magazine 22 complete with the sample tubes 16 each fitted with an O-ring and a metal boat may be sold in sealed packages ready for the samples to be placed on the metal boats by the operator. To assist in loading the boats with samples, the ends of the sample tubes are inset from the edge of the magazine 22 and the boats project from the sample tubes 16 but not beyond the edge of the magazine 22.

Figure 3:
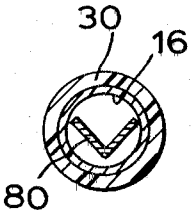
FIG. 3 is a section through a sample tube containing boat, the section being taken through a plane passing through the surrounding O-ring.

Because the samples are pyrolysed by the heating of the boats rather than the tubes 16, it is preferred to ensure that the samples are not cooled by contact with tubes. To achieve this, each boat 80 is V-shaped in cross section, as shown in FIG. 3, and makes contact with the tube 16 at the upper edges of its limbs but not at its base where the sample rests, the boat being wedged within the tube 16 by its own resilience. Such construction of the boats is also advantageous in that it reduces manufacturing costs.

The lower side of the magazine 22 is formed with a groove 32 (shown in dotted lines in FIG. 2) which is engaged by a spring biased indexing pin 34 and acts as part of an indexing mechanism for advancing the magazine automatically, as described in more detail below.

The groove 32 is in the form of a continuous zig-zag formed of portions 32*a* which are parallel to and aligned with the recesses 24 and relatively inclined portions 32*b* connecting one end of each portion 32*a* with the opposite end of the adjacent portion 32*a*. Viewed in the vertical section of FIG. 1, the portions 32*a* of the groove 32 slope downwards from left to right whereas the portions 32*b* slope upwards from left to right.

The indexing pin 34 is mounted on an indexing bar 36 which reciprocates from left to right in FIG. 1. As the pin 34 moves to the right, as viewed, it slides along one of the portions 32*a* without moving the magazine 22 but is itself deflected downwards. On reaching the end of its travel, the pin 34 engages the end of the contiguous portion 32*b* and is clicked upwards into the portion 32*b* by its spring. When now the indexing bar 36 is retracted, the pin slides along the portion 32*b* and simultaneously moves the magazine to align the next sample tube 16 with the feed system and the aperture 12. Once again, on reaching the end of its travel the pin clicks into the next contiguous portion 32*a* of the tube.

An advantage of the above construction of the indexing system is that the movement of the pin 34 is aligned with the inlet aperture and the portion 32*a* of the groove are all aligned with recesses 24. As a result, when the the magazine 22 is first placed with the indexing pin 34 engaged in any one of the portions 32*a*, one of the sample tubes will always be correctly aligned for introduction into the inlet system of the mass spectrometer. The magazine need not therefore always be fed in at its start and one may commence analysis at any desired tube on the magazine. Furthermore, the magazine merely resets by its own weight on the indexing pin 34 so that there is no obstruction to raising and lowering the magazine 22 in any of its positions.

It will also be noticed that the movement of the magazine occurs on the return stroke of the indexing pin rather than its forward stroke. The pin 34, as will be described below, is moved with the mechanism feeding the tubes 16 into the inlet system 10, and as a result the tube aligned with the inlet aperture 12 when the magazine is brought to rest on the index pin 34 will be the tube first fed into the inlet system for analysis.

The indexing bar 36 is provided on its upper surface with an elongated slot in which engages a pin 38 mounted on a carriage 40, the slot and pin 38 together constituting a lost motion coupling. The total stroke of the indexing bar 36 is therefore shorter than the stroke of the carriage 40 by the length of the slot in the upper surface of the indexing bar and the latter only follows the movement of the carriage at the end of the forward and return strokes.

The carriage 40 is guided between two vertical lateral guide plates 42 of which only one is seen in FIG. 1. The upper surface of the carriage is in the form of a rack 44 engaged by a motor driven pinion 46. The carriage 44 rides on rollers 48 which follow a cam track 50. As the carriage is moved from left to right, as viewed, the effect of the cam track is to raise and lower the carriage 40 while enabling it to maintain a horizontal attitude. The motor driving the pinion 46 is also mounted to move vertically with movement of the carriage 40 and is conveniently mounted on an arm pivotably supported on the outer surface of one of the guide plates 42.

The carriage 40 has projecting from its front end a pick-up tube 52 which is split longitudinally at its forward end (the left end as viewed). An ejector pin 54 is received within the pick-up tube 52 at its forward end, the pin 54 having arms 56 which project laterally through the slits in the pick-up tube 52 and move in slots 58 formed in the two guide plates 42. A ring of an elastic material encircles the forward end of the pick-up tube 52 so that the halves of the tube are urged resiliently towards each other.

The feed system is shown in FIG. 1 at the commencement of a feed cycle. The magazine 22 is positioned as earlier described such that one of the sample tubes 16 is aligned with the aperture 12. The motor driving the pinion 46 is now energized and moves the carriage 40 to the right, as viewed. The pick-up tube 52 is moved until its end engages the rear of the sample tube and grips it by virtue of the resilience of the surrounding band.

After this has occured, the rollers 48 ride on the cam track ramps and raise the carriage while the sample tube 16 is maintained horizontal. The arms 56 of the ejector pin at this time are aligned with the ends of the slots 58 and move up the vertical section of the slots. As the pick-up tube 52 continues its forward motion the ejector pin 54 is retracted down the pick-up tube 52.

The ramps on the cam track 50 are dimensioned to raise the sample tube to the level of the aperture 12 of the inlet system of the mass spectrometer. The carriage 40 continues to move forward until first the end of the sample tube 16 abuts the conical surface 14. As the carriage 40 moves still further the pick-up tube 52 engages the O-ring 30 and slides it over the outer surface of the sample tube 16. Finally, when the O-ring 30 abuts the conical surface 14 it is compressed by the pick-up tube 52 and forms a seal. The motor remains energised even after a seal is made to keep a constant pressure on the O-ring 30.

The mass spectrometer now evacuates the sample tube 16 and performs its analysis. After the analysis is complete, the motor driving the pinion 46 is reversed and the carriage 40 moves back towards its illustrated retracted position. The vacuum seal is first broken by the inlet system so that the sample tube 16 may move freely with the pick-up tube 52. As the pick-up tube is withdrawn, the ejector pin 54 is prevented from moving with it by abutment of its arms with the slots 58. The pin 54 thus forms a stop limiting the movement of the sample tube 16 and after it has been pulled clear of the coil 20 it drops back into its own recess 24 in the magazine 22. It is noted that the magazine 22 has still not been moved until this point in the cycle.

The carriage 40 now rides down the ramps of the cam track 50 so that the arms of the ejector pin 54 are freed by the slots 58 and ejector pin moves back with the tube 52. The pin 38 at this stage abuts the rear end of the slot in the upper surface of the indexing bar 36 so that the latter is moved to the left and, as earlier described, advances the magazine so that the next sample tube is aligned with the aperture 12.

The control of the feed system and the evacuation system is performed by a micro-computer which may also serve to correlate the spectrum of the sample, as evaluated by the spectrometer, with a library of stored spectra so as to analyse the spectrum automatically. The entire analysis of a batch of samples may thus be performed rapidly and automatically.

The magazine offers the advantage that the indexing movement is performed automatically without undue complication of the feed system. The magazine may be furthermore inserted and withdrawn in any position and alignment of the sample tubes is always assured.

Though the magazine has been described as a flat rectangular block, it will be clear that it may alternatively be formed as a large diameter carousel unit rotating about a vertical axis.

I claim:

1. A magazine for introducing samples into the inlet system of a mass spectrometer, characterised in that the magazine (22) comprises a flat plate having upper and lower surface which are generally horizontal during use, a zig-zag groove (32) in the lower surface engageable by a reciprocable pin to advance the magazine by increments relative to an aperture (12) of the inlet system of the mass spectrometer and recesses (24) in the upper surface of the magazine (22) for receiving tubes (16) containing samples for analysis, the recesses (24) extending transversely to the direction of movement of the magazine (22) and being arranged at a regular pitch equal to that of the groove (32) in the lower surface.

2. A magazine as claimed in claim 1, characterised in that each recess (24) in the upper surface comprises an enlarged diameter portion (28) for receiving an O-ring (30) placed over the outer surface of the sample tube (16).

3. A magazine as claimed in claim 2, characterised in that each recess (24) in the upper surface is formed at its end remote, during use, from the inlet system (10) of the mass spectrometer with an enlarged diameter portion (26) such that a pick-up tube may be slipped over the end of the sample tube while the latter is resting in the recess.

4. A magazine as claimed in any preceding claim, characterised in that the zig-zag groove (32) has first portions (**32*a*) extending parallel to the recesses (24) in the upper surface and parallel to the direction of movement of the indexing pin such that the movement of the pin, in use, in the first portions causes no movement of the magazine, and second portions (32*b*) each connecting one end of a first portion (32*a*) with the opposite end of an adjacent first portion (32*a*), the second portions (32*b*) being inclined relative to the direction of movement of the magazine during use and cooperating with the pin to move the magazine (22**).

5. A supply of samples for a mass spectrometer comprising a plurality of sample tubes, each fitted with an O-ring and sample boat, resting in recesses in a magazine, said magazine comprising a flat plate having upper and lower surfaces which are generally horizontal during use and a zig-zag groove in the lower surface engageable by a reciprocable pin to advance the magazine by increments relative to an aperture of the inlet system of the mass spectrometer, said recesses being in the upper surface of the magazine, extending transversely to the direction of movement of the magazine, and being arranged at a regular pitch equal to that of the groove in the lower surface.

6. A supply of samples as claimed in claim 5, characterized in that the magazine and the sample tubes are packaged in a sealed wrapper with the boats projecting from the sample tubes but not beyond the edge of the magazine.

* * * * *